US005339140A

United States Patent [19]

Zeman et al.

[11] Patent Number: 5,339,140

[45] Date of Patent: Aug. 16, 1994

[54] METHOD AND APPARATUS FOR CONTROL OF TONER CHARGE

[75] Inventors: Robert E. Zeman, Webster; Thomas K. Hilbert, Spencerport, both of N.Y.

[73] Assignee: Eastman Kodak Company, Rochester, N.Y.

[21] Appl. No.: 971,121

[22] Filed: Nov. 4, 1992

[51] Int. Cl.[5] ..... G03G 21/00

[52] U.S. Cl. ..... 355/246; 355/207; 355/208; 355/214; 355/251; 355/261; 355/245

[58] Field of Search ..... 430/120; 355/245, 246, 355/205, 207, 208, 214, 251, 253, 261; 118/647, 651, 653, 656–658, 689, 690

[56] References Cited

U.S. PATENT DOCUMENTS

| | | | |
|---|---|---|---|
| 4,395,112 | 7/1983 | Miyakawa et al. | 355/246 |
| 4,545,060 | 10/1985 | Miskinis et al. | 430/108 |
| 4,876,575 | 10/1989 | Hays | 118/653 X |
| 4,908,291 | 3/1990 | Fuma et al. | 118/657 X |
| 5,006,897 | 4/1991 | Rimai et al. | 355/246 |
| 5,132,735 | 7/1992 | Howland | 355/261 |
| 5,148,220 | 9/1992 | Hilbert et al. | 355/245 |
| 5,162,854 | 11/1992 | Hilbert et al. | 355/245 |
| 5,183,964 | 2/1993 | Stelter et al. | 355/246 X |
| 5,196,887 | 3/1993 | Hilbert et al. | 355/251 |
| 5,212,522 | 5/1993 | Knapp | 355/208 |
| 5,235,388 | 8/1993 | Rimai et al. | 355/246 |
| 5,285,243 | 2/1994 | Rimai et al. | 355/246 |

*Primary Examiner*—Matthew S. Smith
*Attorney, Agent, or Firm*—Leonard W. Treash

[57] ABSTRACT

The level of charge on toner in a developer is sensed or otherwise determined in an image forming apparatus. In response to such determination, a charge control member is adjusted between positions in which it triboelectrically charges the toner more or less because of greater or lesser contact with the toner.

14 Claims, 2 Drawing Sheets

METHOD AND APPARATUS FOR CONTROL OF TONER CHARGE

This invention relates to the control of charge on toner. Although not limited thereto, it is particularly useful in the development of electrostatic images.

In the development of electrostatic images, toners with a high charge-to-mass ("q/m") will deposit less mass and achieve lower density than low charge-to-mass toners. As electrophotographic technology moves toward higher quality pictorial reproduction, consistency of the density of deposited toner is important to final image quality. Unfortunately, toner charge-to-mass tends to vary substantially. It is sensitive to ambient conditions, such as relative humidity or moisture content of the air.

In two-component development systems, charge-to-mass is also sensitive to percent toner concentration, since the number of carrier charging sites is altered by this variable. Control of toner concentration is relatively poor, routinely permitting substantial changes in charge-to-mass. Charge-to-mass also varies with the age of the developer. U.S. patent application Ser. No. 816,891 to Eric Stelter et al, filed Jan. 3, 1992, suggests monitoring relative humidity and altering the charge-to-mass of a single-component nonmagnetic developer by changing the bias on either or both of a toner-adder roller or a skive. See also, U.S. Pat. No. 4,395,112, Miyakawa et al, and Japanese Kokai 59-140471, published Aug. 11, 1984. However, in two-component systems, the primary approach used to changing charge-to-mass is to adjust toner concentration with the attendant problems mentioned above.

SUMMARY OF THE INVENTION

It is an object of the invention to provide a method and apparatus for controlling the charge on dry toner, particularly in two-component toning systems.

This and other objects are accomplished by moving a developer containing the toner through a path including toning relation with an image member and into contact with a triboelectric charging surface, for example, a surface that is triboelectrically active with respect to said toner, determining the level of charge on the toner and adjusting the extent of contact between the developer and the charging surface to control the level of charge on the toner.

According to preferred embodiments, the charge-to-mass of the toner can be measured or predicted by various means. For example, it can be measured by a charge-to-mass measuring device or is predicted by sensing relative humidity or the density of toner applied. Alternatively, it can be input by a customer who perceives a change in image density or the like.

According to another preferred embodiment, the triboelectric charging surface can be an exterior surface of a roller whose contact is varied either by adjustment of the surface itself or by changing the path of the developer with respect to it.

With the invention, the charge-to-mass of toner can be promptly adjusted to maintain high quality image formation.

DESCRIPTION OF THE PREFERRED EMBODIMENTS

Figure 1:
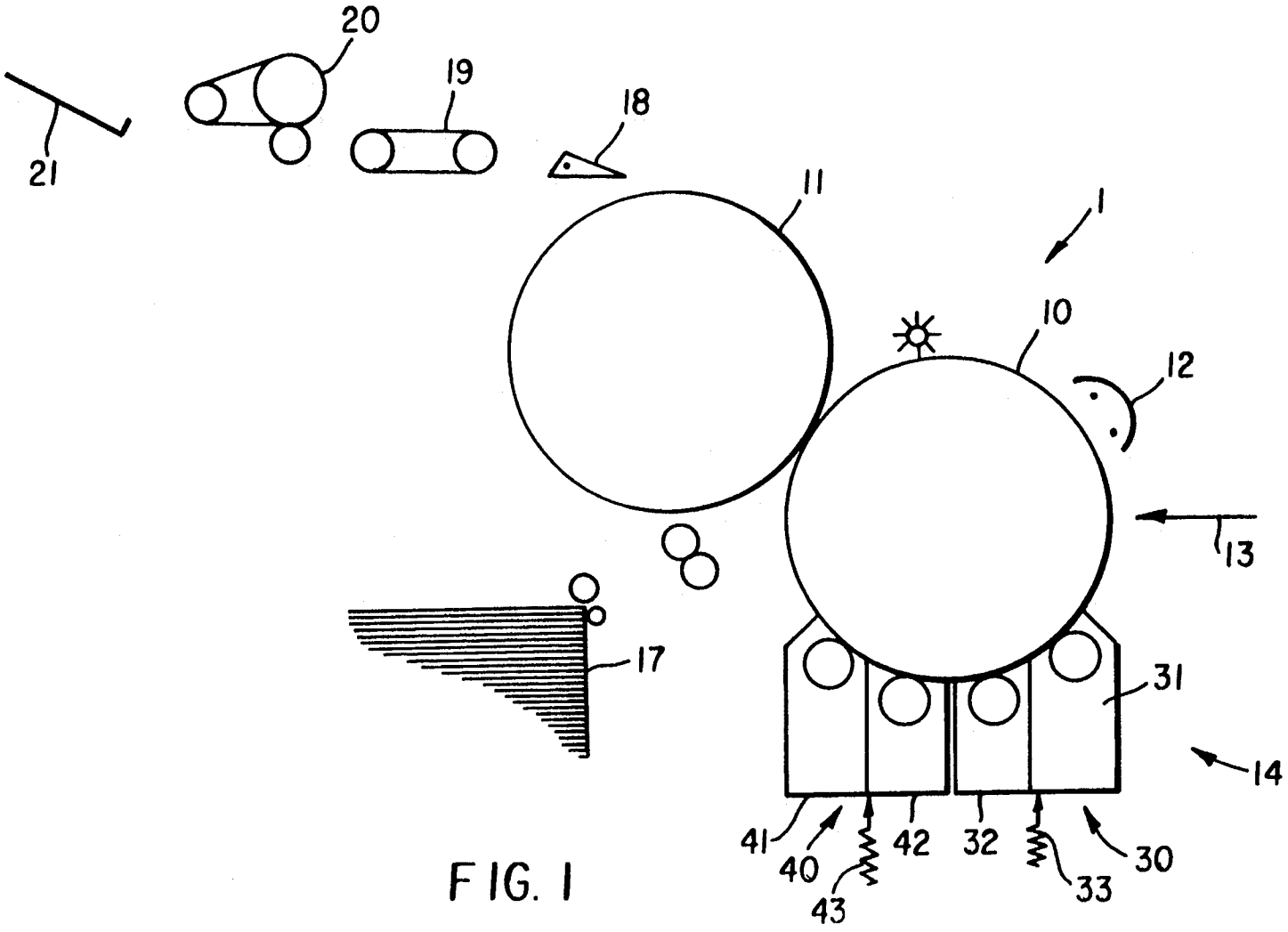
FIG. 1 is a front schematic of an image forming apparatus.

Although not limited thereto, the invention is particularly usable in a multicolor image forming apparatus similar to that shown in FIG. 1. According to FIG. 1, a multicolor image forming apparatus 1 includes an image member 10 which can be a metallic drum having appropriate photoconductive and other layers for forming electrostatic images, all as is well known in the art. Image member 10 could also be a photoconductive or dielectric web wrapped entirely or partially around a cylindrical drum. Image member 10 defines an image surface on which electrostatic images are formed.

Drum-shaped image member 10 is rotated by means, not shown, past a series of stations which include a charging station 12, which applies a uniform charge to the image surface. The charged image surface is exposed by an exposure station, for example, a laser 13, to create a series of electrostatic images. Those images are toned by a cluster 14 of toning stations. Cluster 14 contains four stations 31, 32, 41 and 42, each of which contain a different color toner. Each electrostatic image is toned by one of said stations to create a single-color toner image. A series of images can be toned by different stations to create a series of different color toner images.

Each different color toner image is transferred to a receiving sheet carried by a transfer drum 11 and fed from a receiving sheet supply 17. The receiving sheet is held to transfer drum 11 by conventional means, not shown, for example, vacuum holes, holding fingers or electrostatics. To form multicolor images, each of the single-color images of a series is superposed in registration on the receiving sheet as transfer drum 11 repeatedly rotates the receiving sheet through a nip with image member 10.

Transfer can be accomplished by conventional means, for example, by an electrostatic field or by heat and pressure.

After the desired number of images are transferred in registration to the receiving sheet, it is separated from drum 11 by a separating pall 18 which moves into engagement with drum 11 for this purpose. The receiving sheet is transported by conventional transport means 19 to a fixing device 20 and then to an output tray 21.

Cluster 14 includes four toning or development stations divided into two toning units 30 and 40. Unit 30 includes stations 31 and 32, while unit 40 includes stations 41 and 42. Cluster 14 is symmetrical about a plane between stations 32 and 42, which plane contains an axis of rotation 9 of image member 10. More details with respect to units 30 and 40 and toning stations 31, 32 and 41 and 42 can be obtained from U.S. patent application Ser. No. 07/712,225, filed Jun. 7, 1991, entitled TONING STATION DRIVE FOR IMAGE FORMING APPARATUS, in the name of Hilbert et al, which patent application is incorporated by reference herein.

Figure 2:
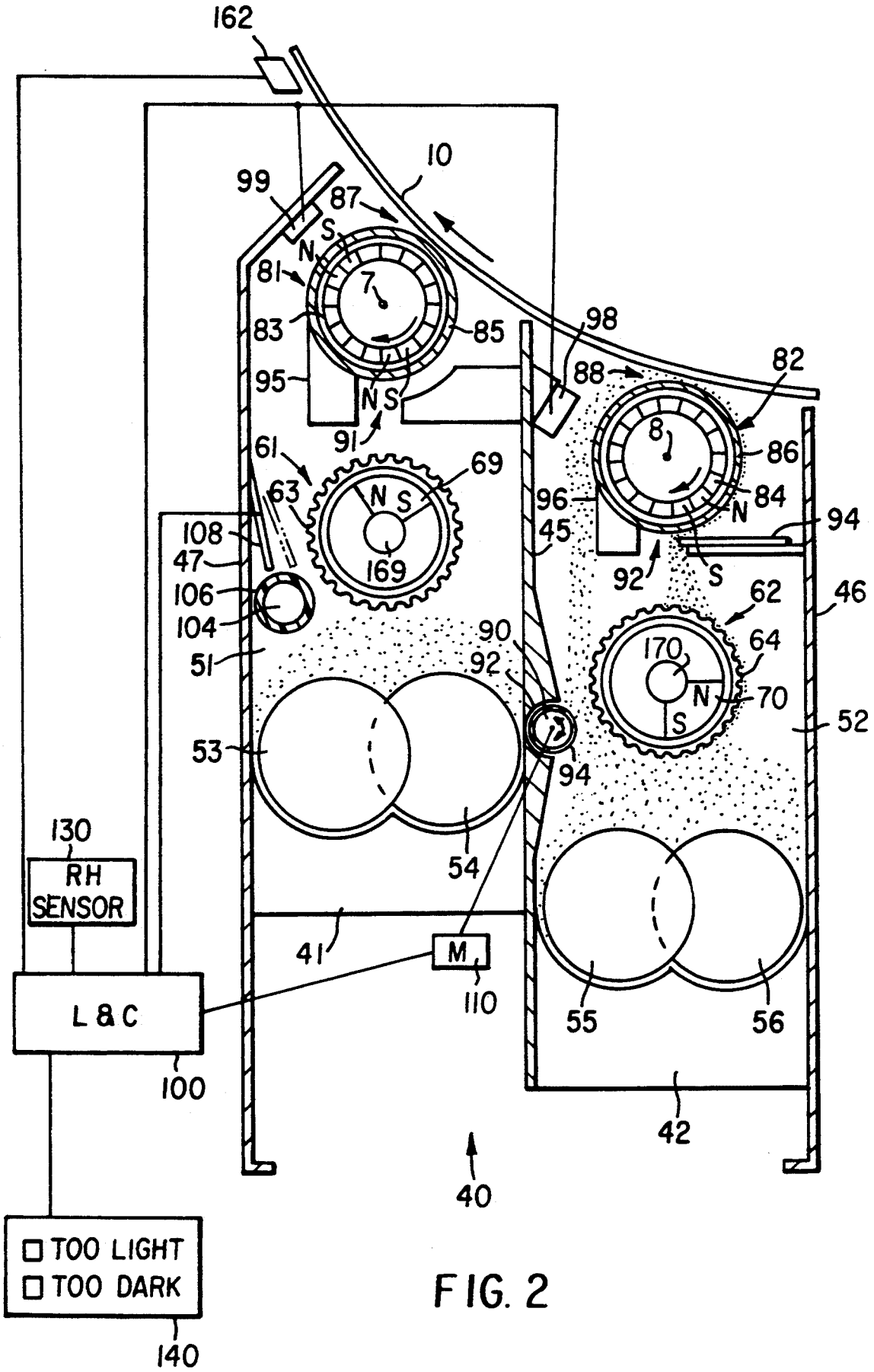
FIG. 2 is a schematic section of a portion of a toning device of the image forming apparatus shown in FIG. 1.

Referring to FIG. 2, toning unit 40 includes a first toning station 41 and a second toning station 42. Toning unit 40 is of a single unitary construction defining development chambers 51 and 52 for both stations. The stations have a common center wall 45 and external sidewalls 46 and 47. Unitary endwalls, not shown, further define both stations.

Within each of development chambers 51 and 52 are mounted a pair of mixing devices, for example, paddle mixers 53 and 54 and 55 and 56, respectively. Mixing devices 53–56 are in the bottom of developer sumps forming the bottom of chambers 51 and 52. They are rotated rapidly to thoroughly mix a two-component developer and raise the level of developer until it comes under the influence of developer transport devices 61 and 62 in each station.

Developer transport devices 61 and 62 include rotatable transport rollers 63 and 64, respectively, each of which have an outer fluted surface for transporting developer.

At the top of stations 41 and 42 are applicators 81 and 82, respectively. Each applicator includes a rotatable magnetic core 83 and 84 and a nonmagnetic sleeve 85 and 86. As seen in FIG. 2, magnetic cores 83 and 84 are rotatable in a clockwise direction which causes developer having a magnetic component to move in a counterclockwise direction around sleeves 85 and 86. This type of applicator can be used with single-component magnetic developer or conventional two-component developer having a magnetic carrier. However, it is preferably used with a two-component developer having a hard magnetic carrier and a nonmagnetic insulative toner such as those described in U.S. Pat. No. 4,546,060, Miskinis et al, issued Oct. 8, 1985. With such developer, rapid rotation of cores 83 and 84 causes the developer to move around sleeves 85 and 86 in a direction opposite to the direction of rotation of the core, bringing the developer through developing or toning positions 87 and 88 between sleeves 85 and 86 and the image surface of image member 10. Flow of developer around sleeves 85 and 86 can also be affected by rotation of sleeves 85 and 86 in either direction, as is well known in the art.

Flow of developer from the bottom or sump portion of chambers 51 and 52 is controlled by several means. Developer above mixers 53–56 is attracted to transport rollers 63 and 64 by magnetic gates 69 and 70. As shown with respect to station 42, developer above mixers 55 and 56 is attracted into contact with roller 64 by magnetic gate 70. Rotation of roller 64 brings the developer held by gate 70 up to the top of transport device 62 where it is attracted by core 84 in applicator 82. With magnetic gate 70 in the position shown with respect to toning station 42, station 42 is applying developer to an electrostatic image passing through developing position 88 on the image surface of image member 10.

As shown with respect to station 41, magnetic gate 69 has been rotated until it is facing applicator 81. In this position no developer is attracted to the transport roller 63, and developer is inhibited from leaving the top of transport device 61, thereby shutting off the supply of developer to applicator 81 to prevent toning by toning station 41 of an electrostatic image passing through developer position 87. This structure, merely by the rotation of magnetic gate 69, controls whether or not station 41 applies toner to a passing electrostatic image. The stations do not need to be moved into and out of toning position between images.

Developer leaving transport roller 64 passes through an opening 92 associated with applicator 82 which assists in metering the amount of toner moved by applicator 82. As shown with respect to toning station 42, opening 92 can be given a factory or field adjustment size by moving a sliding plate 94. With respect to toning station 41, the top of opening 91 is shown permanently formed. Obviously, in commercial use, both stations would have the same structure. They are shown different in FIG. 2 to show some of the variations possible.

Developer leaving developing positions 87 and 88 is separated from sleeves 85 and 86 by skives 95 and 96. As shown with respect to toning station 41, skive 95 and opening 91 can be defined by substantially the same element positioned and attached to center wall 45.

Developer skived off shells 85 and 86 by skives 95 and 96 falls back into sumps 51 and 52 for remixing by mixers 53–56. Thus, the developer continuously moves through an endless path which brings it from the sumps 51 and 52 to the developing positions 87 and 88 where it passes through development or toning relation with an electrostatic image. The developer, with some of its toner removed by the electrostatic image, continues on the path, falling back into the sump where toner is replenished and the mixture further charged.

In the two-component system illustrated, charging is accomplished triboelectrically by the mixing action of the two-component developer, as is well known in the art. As pointed out above, the charge-to-mass of the toner can vary substantially in such a system. To control the charge-to-mass and thereby the quality of the image, a charge controlling system is used which senses or otherwise determines the charge-to-mass of the toner, and in response to such determination, changes the charge-to-mass accordingly.

As shown in FIG. 2, toning station 42 employs a charge-to-mass sensor or monitor 98 which senses the charge-to-mass of the toner associated with the developer leaving the developing position 88. The value sensed by sensor 98 is fed back to a logic and control 100. A charge control member 90 is positioned along the path of the developer as it returns to the sump. Charge control member 90 has a triboelectric charging surface 94 of a material which is triboelectrically active with respect to the toner. That is, contact with the toner has a tendency to increase the charge of the toner. For example, most positively charged toners will increase their charge if they are rubbed against a polytetrafluoroethylene surface. Thus, if member 90 has a surface 94 of polytetrafluoroethylene, it contributes to the charge-to-mass of the toner contacting it.

Charge control member 90 is in fact a roller which can be rotated to present any portion of its surface to the passing toner. Approximately one-half of the external surface of member 90 is a portion 94 coated with polytetrafluoroethylene and the other half is a portion 92 of anodized aluminum. If the polytetrafluoroethylene portion 94 is exposed to the developer as it passes, the charge-to-mass of the toner in the developer will be substantially increased compared to toner which contacts only the anodized aluminum portion 92 of the roller surface.

Thus, if charge-to-mass monitor 98 signals to logic and control 100 that the charge-to-mass of the toner is higher than optimum, logic and control 100 signals a motor 110 which rotates roller 90 to present the anodized aluminum portion 92 of the surface to the developer. On the other hand, if the monitor 98 indicates that the charge-to-mass of the toner is less than desired, the polytetrafluoroethylene portion 94 is positioned to contact the developer to raise the charge-to-mass. If the charge-to-mass is accurately positioned, the member 90 is positioned with a portion of each surface exposed to the developer. Logic and control 100 can vary the amount of each of portions 92 and 94 that are exposed through a range of values until the charge-to-mass of the toner stabilizes at the desired value.

Station 41 shows an alternative structure for the charge control member. In station 41 a charge control member 104 includes an exterior surface of polytetrafluoroethylene 106. The charge control member 104 is stationary but is protected by a diverter 108 which can be moved from a nondiverting position shown in FIG. 2 to a diverting position shown in phantom in FIG. 2. If the charge sensed by a charge-to-mass monitor 99 is too high, the diverter 108 is moved from the position shown in FIG. 2 to the position shown in phantom to deflect the developer away from charge control member 104, thereby reducing its charge-to-mass ratio.

The choice of charge control agents applied to the charge control member (90, 104) is wide and can be varied to suite the charging ability of the particular toners in use. The choice of such materials for triboelectric charge control in carriers has been part of electrophotography since its infancy. For example, for polyester or styrene-based toners, such as styrene butyl acrylate, charge control agents that typically increase the toner's charge level include tetrafluoroethylene vinylidene fluoride copolymer, trifluorochloroethylene vinylidene fluoride and hexafluoropropylene, whereas bare metal, polymethylmethacrylate and polystyrene typically lower the charge level.

Although the use of charge-to-mass sensing devices such as monitors 98 and 99 is preferred, the determination of charge-to-mass can be made by less direct approaches. For example, the relative humidity can be sensed by an RH sensor 130, since it is known that charge-to-mass will vary substantially with relative humidity. In response to sensing a change in relative humidity, the charge control devices 90 and 104 can be moved accordingly to compensate for that ambient condition.

Further, since it is known that a high charge-to-mass ratio will result in an image that is lighter than a low charge-to-mass ratio, an operator can use a conventional control device 140 to input to logic and control 100 that the operator perceives the image to be too light or too dark. The logic and control then adjusts the charge-to-mass ratio accordingly, for example, increasing the charge-to-mass if the image is too dark. Alternatively, this latter approach can be accomplished automatically using a densitometer 162 which determines the density of a patch provided on the image member for that purpose or directly senses the density of the image itself.

Charge-to-mass monitor 98 or 99 can be constructed of a number of types, for example, see U.S. Pat. Nos. 5,006,897 and 5,034,775, both of which patents are incorporated by reference herein.

The invention has been described in detail with particular reference to a preferred embodiment thereof, but it will be understood that variations and modifications can be effected within the spirit and scope of the invention as described hereinabove and as defined in the appended claims.

We claim:

1. Method of applying a charged toner to an image member from a developer of which said toner is at least a component, said method comprising the steps of:

moving the developer through a path which brings the developer into toning relation with said image member and into contact with a triboelectric charging surface, determining the level of charge on said toner, and adjusting the extent of contact between said developer and said triboelectric charging surface to control the level of the charge on the toner.

2. The method according to claim 1 wherein said determining step is accomplished by sensing the charge-to-mass ratio of toner in said developer moving through said path.

3. The method according to claim 1 wherein said determining step is accomplished by sensing ambient relative humidity.

4. The method according to claim 1 wherein said determining step is accomplished by examination of image density.

5. The method according to claim 1 wherein said determining step is accomplished by sensing toner density on said image member.

6. The method according to claim 1 wherein said developer is a two-component developer including carrier which triboelectrically charges said toner when mixed with it.

7. The method according to claim 6 wherein said carrier is magnetic and said moving step is accomplished in part by rotation of a magnetic member.

8. Apparatus for forming a toner image on an image member, said apparatus comprising:

an image member, means for forming an electrostatic image on said image member, means for holding a supply of developer having a toner as a component, a charge control member having a surface of a material triboelectrically active with respect to said toner, means for moving said developer through a path in which it passes through toning relation with said electrostatic image and through charging contact with said surface of said charge control member, and means for adjusting the extent of said contact between said developer and said surface of said charge control member.

9. Apparatus according to claim 8 wherein said charge control member is a member having a surface which varies from portion to portion in its charging effect on said toner, and said apparatus includes means for varying the portion of said surface contacting said developer.

10. Apparatus according to claim 8 wherein said charge control member is a rotatable roller with a periphery only a portion of which is exposed at any time to said developer and which periphery has a variable charging effect and said apparatus includes means for rotating said roller to vary the portion of said periphery exposed to said developer.

11. Apparatus according to claim 8 wherein said apparatus includes adjustable means for diverting developer away from contact with said charge control member, which adjustable means is adjustable between first and second positions diverting more and less developer, respectively.

12. Apparatus according to claim 8 further including means for sensing the level of charge on toner in the developer moving through said path and means for controlling the adjusting means in response to the level of charge sensed.

13. Apparatus according to claim 8 further including means for sensing ambient relative humidity and for controlling the adjusting means in response to said sensed ambient relative humidity.

14. Apparatus according to claim 8 further including means for receiving an input indicative of a desire that an image be made lighter or darker, and means responsive to such input for controlling the adjusting means.

* * * * *